US008146577B2

(12) United States Patent
Hu

(10) Patent No.: US 8,146,577 B2
(45) Date of Patent: Apr. 3, 2012

(54) ELECTRIC TOY GUN WITH AN IMPROVED POWER BREAK CONTROL MECHANISM

(76) Inventor: Shih-Che Hu, Yung Kang (TW)

( * ) Notice: Subject to any disclaimer, the term of this patent is extended or adjusted under 35 U.S.C. 154(b) by 289 days.

(21) Appl. No.: 12/703,404

(22) Filed: Feb. 10, 2010

(65) Prior Publication Data

US 2011/0192386 A1 Aug. 11, 2011

(51) Int. Cl.
*F41B 11/00* (2006.01)

(52) U.S. Cl. ..... 124/32; 124/67; 124/77

(58) Field of Classification Search ..... 124/32, 124/66, 67, 77
See application file for complete search history.

(56) References Cited

U.S. PATENT DOCUMENTS

| | | | | |
|---|---|---|---|---|
| 5,531,210 | A * | 7/1996 | Meiser et al. | 124/66 |
| 6,564,788 | B1 * | 5/2003 | Hu | 124/66 |
| 6,772,746 | B2 * | 8/2004 | Gabrel | 124/32 |
| 6,948,487 | B2 * | 9/2005 | Rice et al. | 124/32 |
| 2006/0243263 | A1 * | 11/2006 | Tsurumoto | 124/66 |
| 2008/0078369 | A1 * | 4/2008 | Yeung | 124/67 |
| 2009/0133679 | A1 * | 5/2009 | Yeh | 124/32 |

* cited by examiner

*Primary Examiner* — John Ricci
(74) *Attorney, Agent, or Firm* — Pro-Techtor Int'l Services

(57) ABSTRACT

An electric toy gun having therein a power break control mechanism consisting of an actuator, a power break control set and a swinging block for breaking off power supply upon triggering of the trigger when the clip is empty. When the clip is empty and when the trigger is pressed, the actuator is forced by a spring-loaded push rod at the bullet outlet of the clip to move the swinging block and the power break control set, causing a power break holder to be moved away from a power contact holder, and therefore power supply is disconnected, avoiding waste of power supply and component damage.

10 Claims, 9 Drawing Sheets

ELECTRIC TOY GUN WITH AN IMPROVED POWER BREAK CONTROL MECHANISM

BACKGROUND OF THE INVENTION

1. Field of the Invention

The present invention relates to toy gun power control techniques and more particularly, to a power break control mechanism used in an electric toy gun that breaks power supply when the clip is empty and when the trigger is pressed.

2. Description of the Related Art

The driving principle of an electric toy gun is completely different from that of an air-soft toy gun. When the trigger of an electric toy gun is pressed, a power break holder is moved into contact with a power contact holder in the inside of the gun body to start the firing mechanism. When firing, a battery-operated gearwheel set 10 is driven to move a piston set 30 toward the rear side in the gun body 20 (see FIG. 1). The piston set 30 has a return spring 301 loaded thereon. When rotating the gearwheel set 10 to a predetermined position, the piston set 30 is released from the gearwheel set 10, and the return spring 301 immediately returns the piston set 30 forwards to its former position, allowing discharge of a compressed gas to drive a toy bullet out of the gun barrel. Thus, one firing action is done, and the toy gun is reset for a next firing action.

When wishing to fire toy bullets repeatedly, the aforesaid firing action is repeated. The power break holder will be moved away from the power contact holder to break off power supply only when the trigger is released. If the clip is empty and the trigger is kept pressed, the gearwheel set 10 is kept to drive the piston set 30 moving forwards and backwards, and the operator can know the situation only when no toy bullet is fired. It is nonsense to keep the gearwheel set 10 and the piston set 30 moving when the clip is empty. This condition wastes power supply, and may cause component damage.

SUMMARY OF THE INVENTION

The present invention has been accomplished under the circumstances in view. It is therefore the main object of the present invention to provide an electric toy gun having therein a power break control mechanism that breaks power supply when the clip is empty and when the trigger is pressed, avoiding waste of power supply and component damage.

To achieve this and other objects of the present invention, an electric toy gun comprises a power break control mechanism, a gearwheel set, a power break holder, a power contact holder, a trigger and a clip. The trigger has a protrusion adapted for moving the power break holder forwardly to contact with the power contact holder when the trigger is pressed. The power break holder is spring loaded for automatic return after having been moved forwards. The clip has a bullet outlet and a spring-loaded push rod pivotally connected to a part thereof near the bullet outlet. The power break control mechanism is adapted to break off power supply when the trigger is released after each firing action. The gearwheel set has a push rod. The spring-loaded push rod has a side protrusion. The power break control mechanism comprises an actuator, a power break control set and a swinging block. The spring-loaded push rod of the clip is turned upwards to force the side protrusion against the actuator and to further bias the power break control set to a position where a rear side of the power break control set is lowered to one lateral side of the swinging block when the clip is empty, therefore when the gearwheel set is rotated to force the push rod thereof against the swinging block upon triggering of the trigger at this time, the swinging block is rotated to move the power break control set in moving the power break holder away from the protrusion of the trigger for enabling the power break holder to be biased backwards by spring means loaded thereon to break off power supply. The gearwheel set comprises a first gearwheel carrying the push rod of the gearwheel set. The swinging block is spring loaded for automatic return, having a pivot hole coupled to a first pivot inside the electric toy gun for enabling the swinging block to be turned about the first pivot and an arched hole coupled to a second pivot inside the electric toy gun to limit the turning angle of the swinging block about the first pivot.

Further, the power break control set comprises a swivel rod and a power break control block. The swivel rod has a middle part thereof pivotally connected to a front part of the power break control block for enabling the swivel rod to be moved with the power break control block when the swinging block is forced to move the power break control set. The power break control block has an elongated slot and a beveled edge. The elongated slot of the power break control block is coupled to a fixed guide rod in the electric toy gun for enabling the power break control block to move horizontally when the swivel rod is biased. The power break holder has a stop rod. When the swinging block is forced to move the power break control set, the beveled edge of the power break control block is forced against the stop rod of the power break holder, causing the power break holder to be moved away from the protrusion of the trigger. The beveled edge of the power break control block slopes downwardly forwards. The power break control block moves horizontally when the power break control set is moved by the swinging block. The swivel rod is forced to move the power break control block in horizontal when pushed by the swinging block.

Further, the actuator comprises a first link, a second link and a third link. The second link is coupled between the first link and the third link. The third link has a bearing portion adapted for moving the front end of the swivel rod upwards when the side protrusion of the spring-loaded push rod is turned upwards to move the actuator. The actuator is spring loaded for automatic position return when the side protrusion of the spring-loaded push rod is moved away from the first link. The swivel rod is kept in a forwardly downwardly sloping position when the side protrusion of the spring-loaded push rod is kept away from the actuator; the swivel rod is turned to horizontal to keep a rear end thereof at one lateral side relative to the swinging block when the side protrusion of the spring-loaded push rod touches the actuator.

The actuator further comprises a reset button located on the third link and extending out of the electric toy gun for pressing by a user to return the swivel rod from the horizontal position to the forwardly downwardly sloping position.

DETAILED DESCRIPTION OF THE PREFERRED EMBODIMENT

Figure 1:
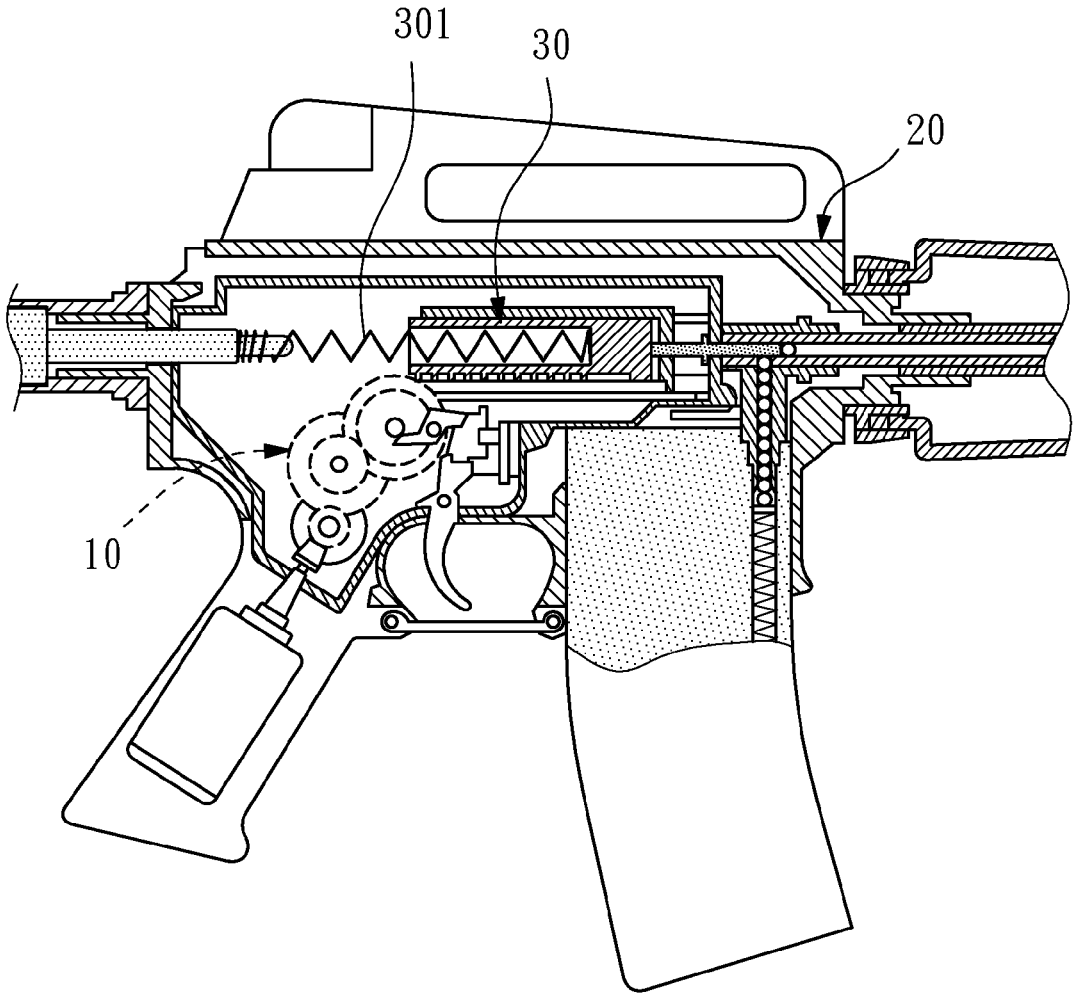
FIG. 1 (PRIOR ART)
FIG. 1 is a schematic drawing showing the driving mechanism of a conventional electric toy gun.
Figure 2:
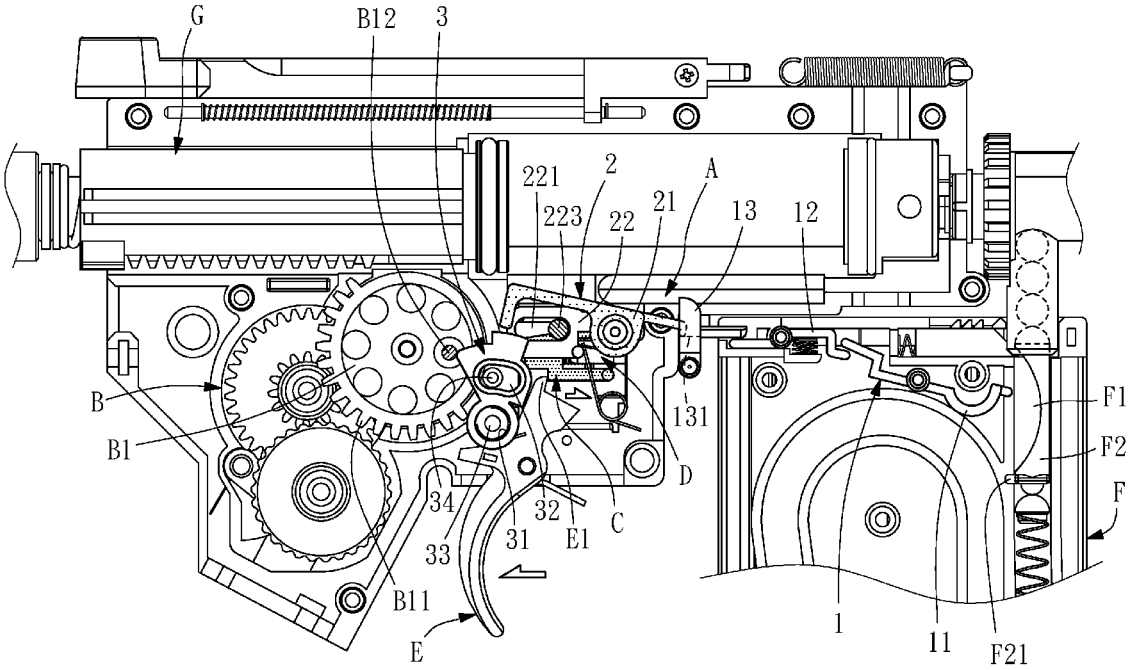
FIG. 2 is a schematic plain view of a part of an electric toy gun embodying the present invention (the clip has toy bullets therein).
Figure 3:
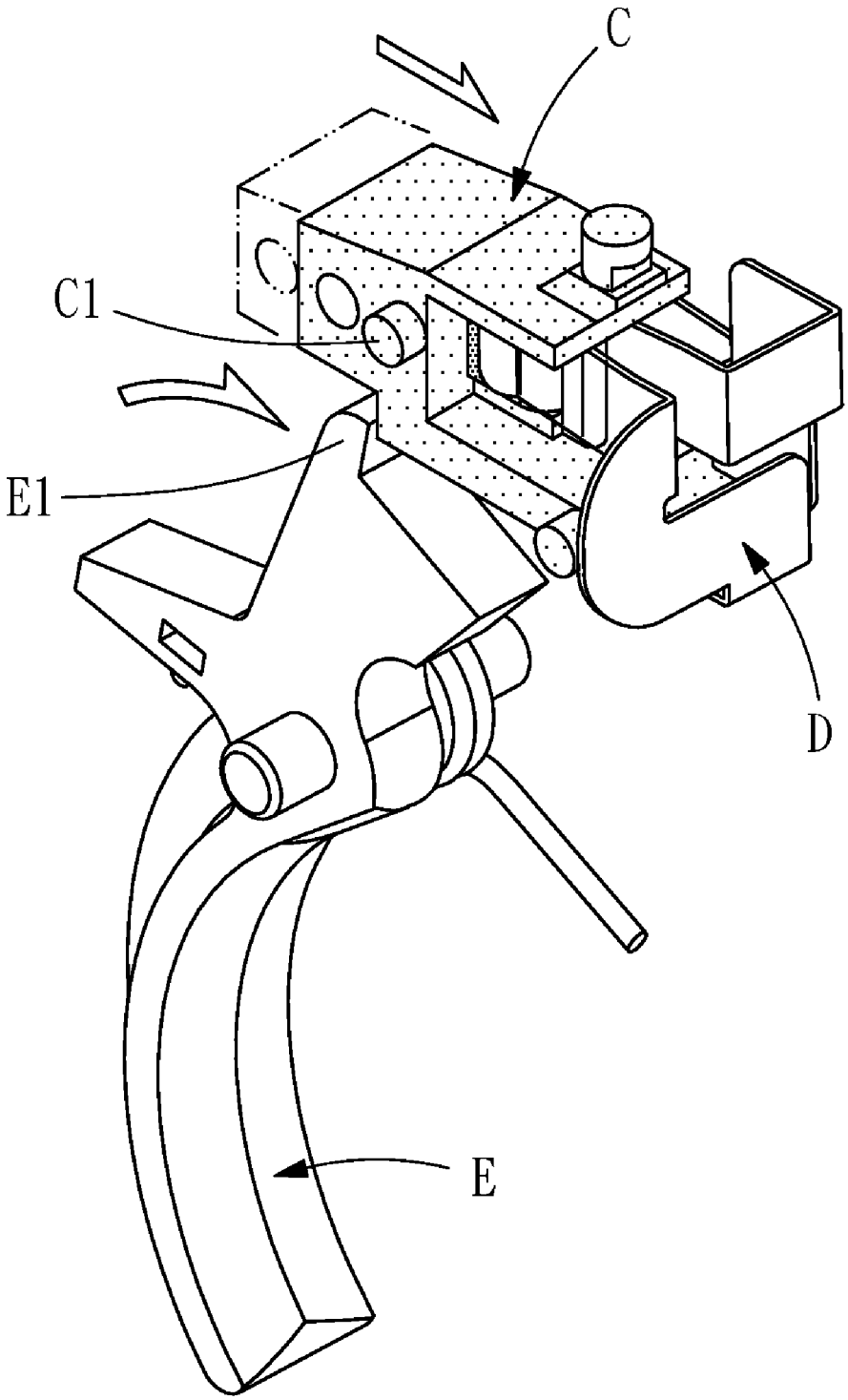
FIG. 3 is a schematic view of a part of the present invention, showing the trigger pressed and the power break holder forced into contact with the power contact holder.

Referring to FIG. 2, a power break control mechanism A is shown installed in the gun body of an electric toy gun. The electric toy gun comprises a gearwheel set B, a power break holder C, a power contact holder D, a trigger E and a clip F (see FIGS. 3 and 4 for the power break holder C and the power contact holder D). The gearwheel set B includes a first gearwheel B1 having a gear sector B11 for moving a piston set G. The first gearwheel B1 has a push rod B12. The trigger E has a protrusion E1. When presses the trigger E, the protrusion E1 is forced to move the power break holder C forwards into contact with the power contact holder D, thereby connecting power supply (see FIG. 3) and moving the gearwheel set B. Further, the power break holder C can be returned to its former position automatically. Further, the power break holder C has a stop rod C1 (see FIG. 4). Further, the clip F has a bullet outlet F1 and a spring-loaded push rod F2 pivotally connected to a part thereof near the bullet outlet F1. The spring-loaded push rod F2 has a side protrusion F21.

Figure 4:
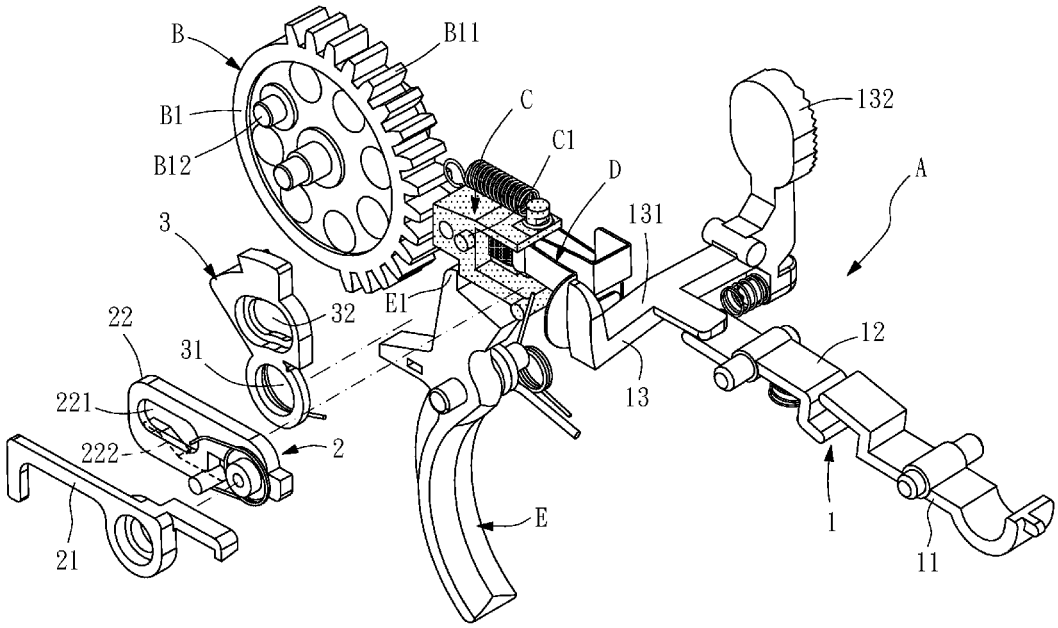
FIG. 4 is an exploded view of the preferred embodiment of the present invention.

The power break control mechanism A comprises an actuator 1, a power break control set 2 and a swinging block 3 (see FIGS. 2 and 4).

Figure 5:
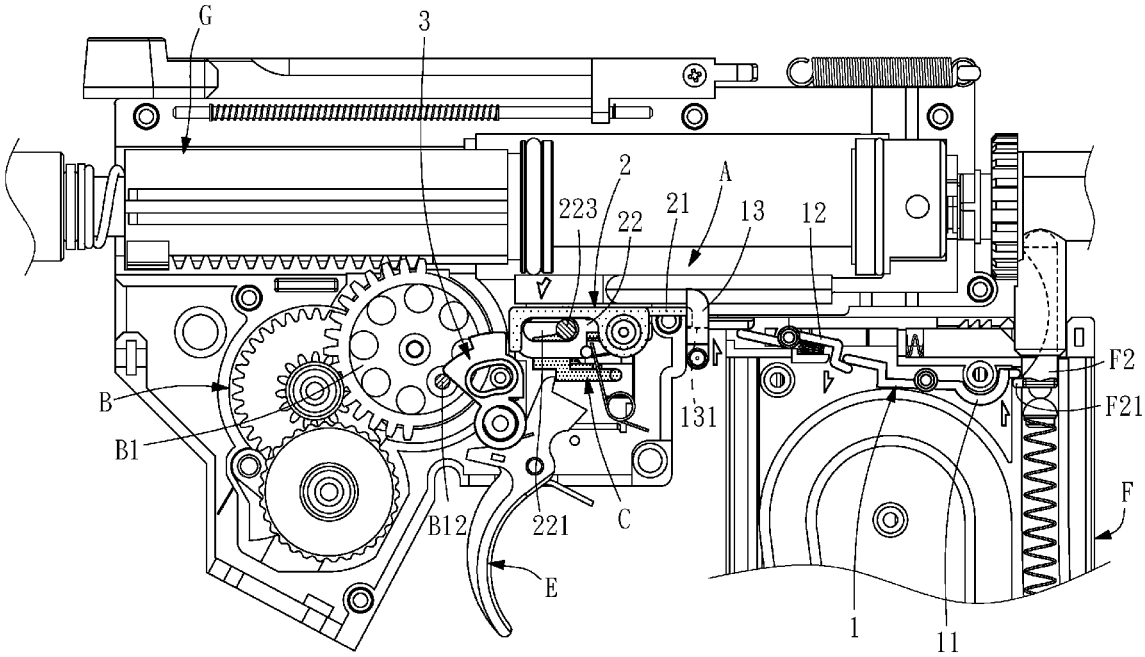
FIG. 5 corresponds to FIG. 2, showing the clip empty.

The actuator 1 comprises a first link 11, a second link 12 and a third link 13. The second link 12 is coupled between the first link and the third link 13. When the clip F is empty, the spring-loaded push rod F2 is moved upwards to force the side protrusion F21 against the first link 11 of the actuator 1, thereby moving the second link 12 and the third link 13 (see FIG. 5). Further, the third link 13 has a bearing portion 131. Further, when the side protrusion F21 is kept away from the first link 11 of the actuator 1, the first link 11, the second link 12 and the third link 13 are returned to their former positions.

Figure 6:
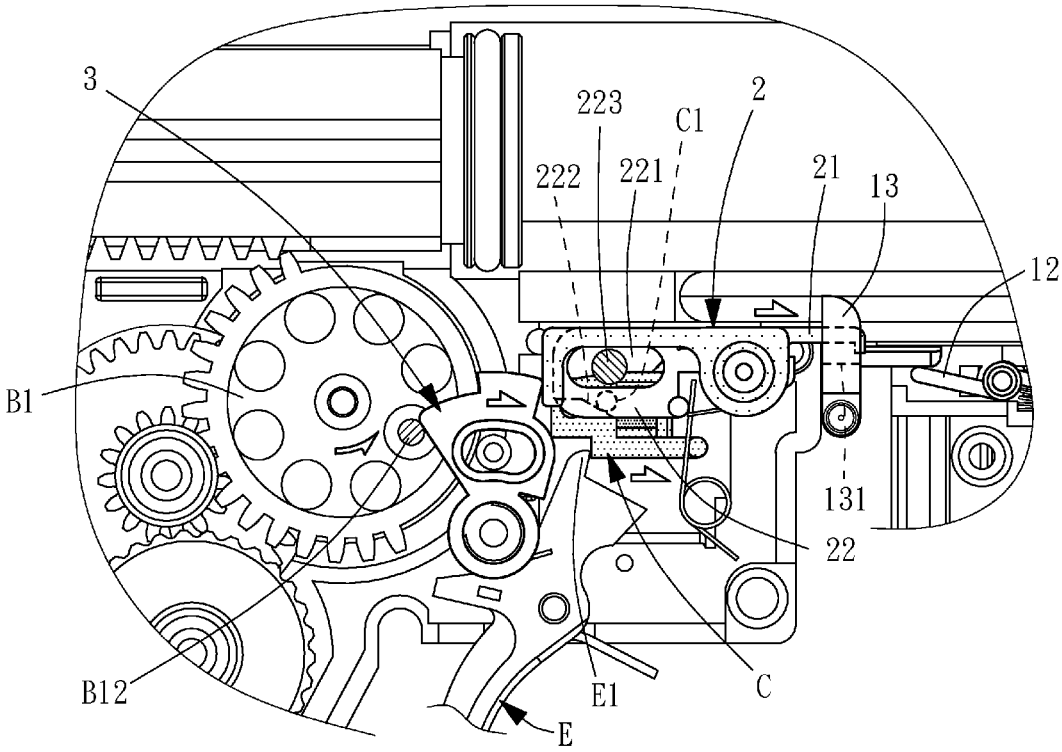
FIG. 6 is a schematic drawing showing the beveled edge of the break block forced forwards against the stop rod of the power break holder and the power break holder moved away from the trigger (I).

The power break control set 2 comprises a swivel rod 21 and a power break control block 22 (see FIG. 4). The swivel rod 21 has the middle part thereof pivotally connected to the front part of the power break control block 22 for displacement with the power break control block 22. When the side protrusion F21 of the spring-loaded push rod F2 touches the first link 11 of the actuator 1 (see FIG. 5), the bearing portion 131 of the third link 13 is forced to push the front end of the swivel rod 21 of the power break control set 2, biasing the swivel rod 21 to the position where the rear end of the swivel rod 21 reaches one lateral side of the swinging block 3. Further, the power break control block 22 has an elongated slot 221 and a beveled edge 222 (see FIG. 4). A guide rod 223 is fixedly mounted inside the gun body and inserted through the elongated slot 221. The beveled edge 222 slopes downwardly forwards and is disposed below the stop rod C1 of the power break holder C (see FIG. 6). Further, the swivel rod 21 is constantly kept in a downwardly forwardly sloping position before upward movement of the spring-loaded push rod F2 of the clip F to force the side protrusion F21 against the actuator 1 (see FIG. 2). When the side protrusion F21 touches the actuator 1, the swivel rod 21 is turned from the forwardly downwardly sloping position to a horizontal position to lower the rear end thereof to one lateral side of the swinging block 3 (see FIG. 5).

Figure 7:
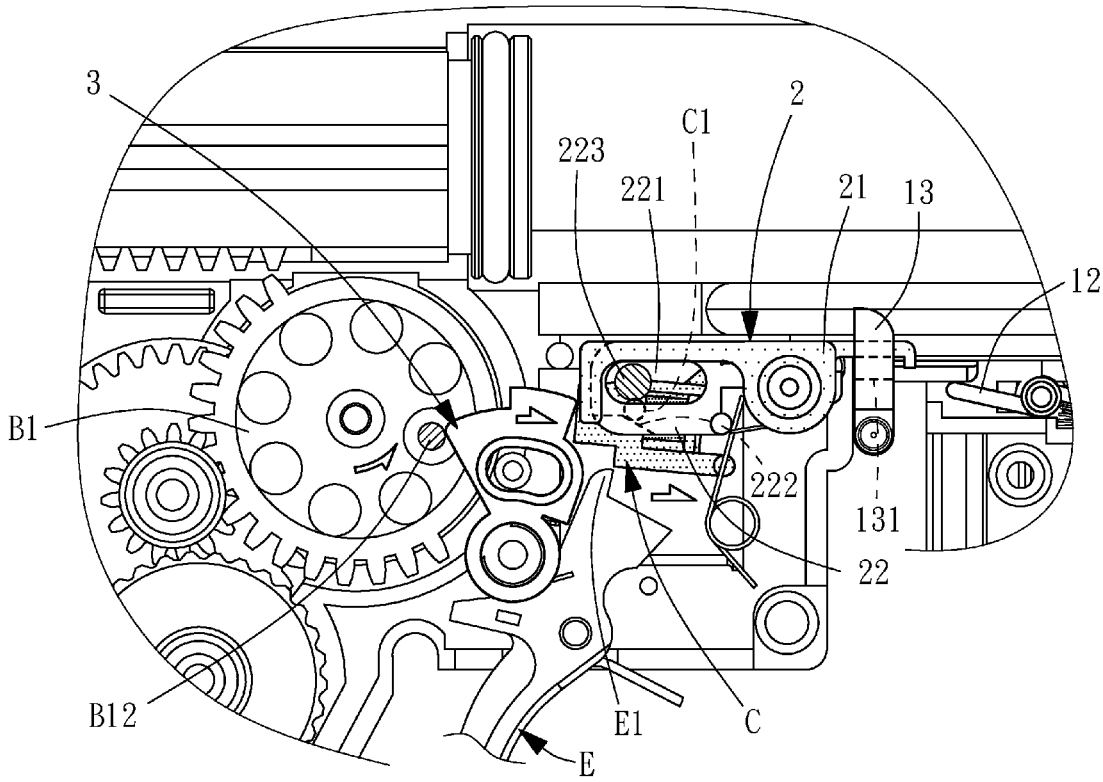
FIG. 7 is a schematic drawing showing the beveled edge of the break block forced forwards against the stop rod of the power break holder and the power break holder moved away from the trigger (II).
Figure 8:
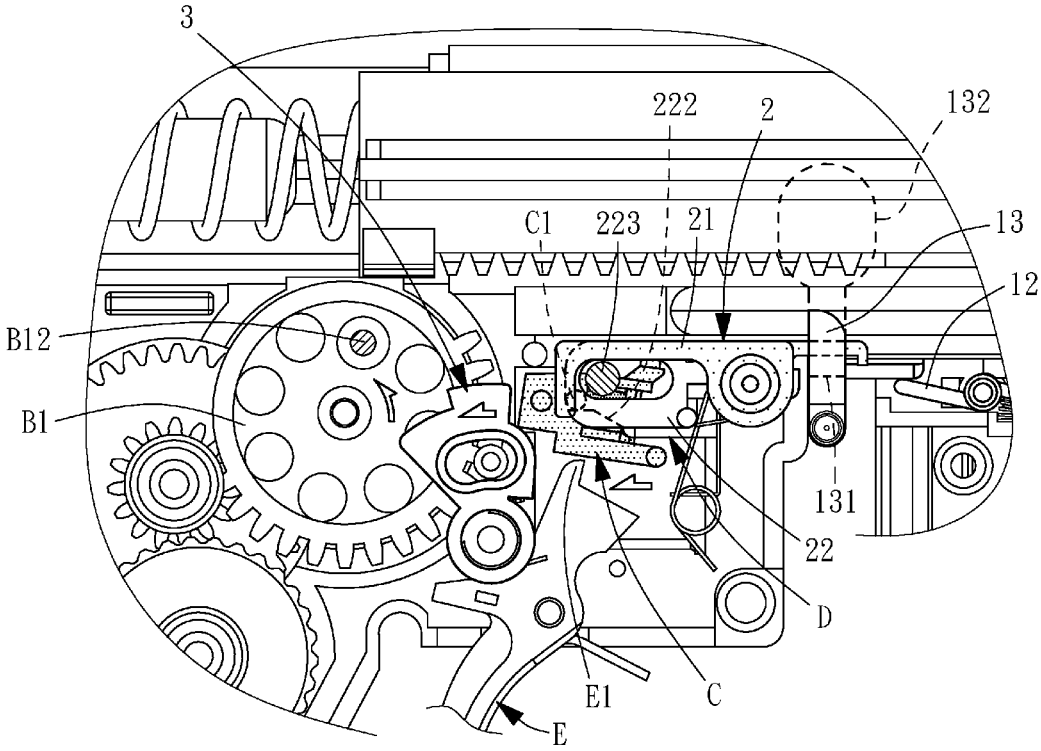
FIG. 8 corresponds to FIG. 7, showing the power break holder returned to its former position.

The swinging block 3 has a pivot hole 31 and an arched hole 32. The pivot hole 31 is pivotally coupled to a pivot 33 that is fixedly mounted in the gun body of the electric toy gun. Further, the swinging block 3 is spring loaded for automatic return after being biased. The arched hole 32 is coupled to a pivot 34, which limits the swinging angle of the swinging block 3. During rotation of the first gearwheel B1, the push rod B12 biases the swinging block 3 forwards to push the swivel rod 21 of the power break control set 2 (see FIG. 6), thereby causing the power break control block 22 to be moved with the swivel rod 21. Due to the constraint of the pivot 223, the power break control block 22 is moved horizontally at this time. Further, when the swinging block 3 pushes the power break control set 2 forwards, the beveled edge 222 of the power break control block 22 is forced against the stop rod C1 of the power break holder C, moving the power break holder C away from the protrusion E1 of the trigger E (see FIG. 7), thus the power break holder C is released from the constraint of the trigger E and returned backwards to its former position away from the power contact holder D, thereby breaking off power supply (see FIG. 8).

When presses the trigger E, the protrusion E1 pushes the power break holder C forwards into contact with the power contact holder D to connect power supply, causing the gearwheel set B to rotate. If the clip F has toy bullets therein at this time, the side protrusion F21 of the spring-loaded push rod F2 of the clip F will not touch the actuator 1 (see FIG. 2). If the clip F is empty at this time, the side protrusion F21 of the spring-loaded push rod F2 of the clip F will touch and move the first link 11 of the actuator 1, causing the bearing portion 131 of the third link 13 to be moved upwards against the front end of the swivel rod 21 of the power break control set 2, and therefore the rear end of the swivel rod 21 will be lowered to one lateral side of the swinging block 3 (see FIG. 5). When the first gearwheel B1 is rotated to the position where the push rod B12 pushes the swivel rod 21 of the power break control set 2, the power break control block 22 is moved with the swivel rod 21 to force the beveled edge 222 against the stop rod C1 of the power break holder C, thereby lifting the rear side of the power break holder C away from the protrusion E1 of the trigger E (see FIGS. 6 and 7; power control holder D is not shown in FIGS. 6 and 7). Thereafter, the power break holder C is returned to its former position, and moved away from the power contact holder D to break off power supply (see FIG. 8). Thus, when the clip F is empty, power supply will be automatically broken off.

Figure 9:
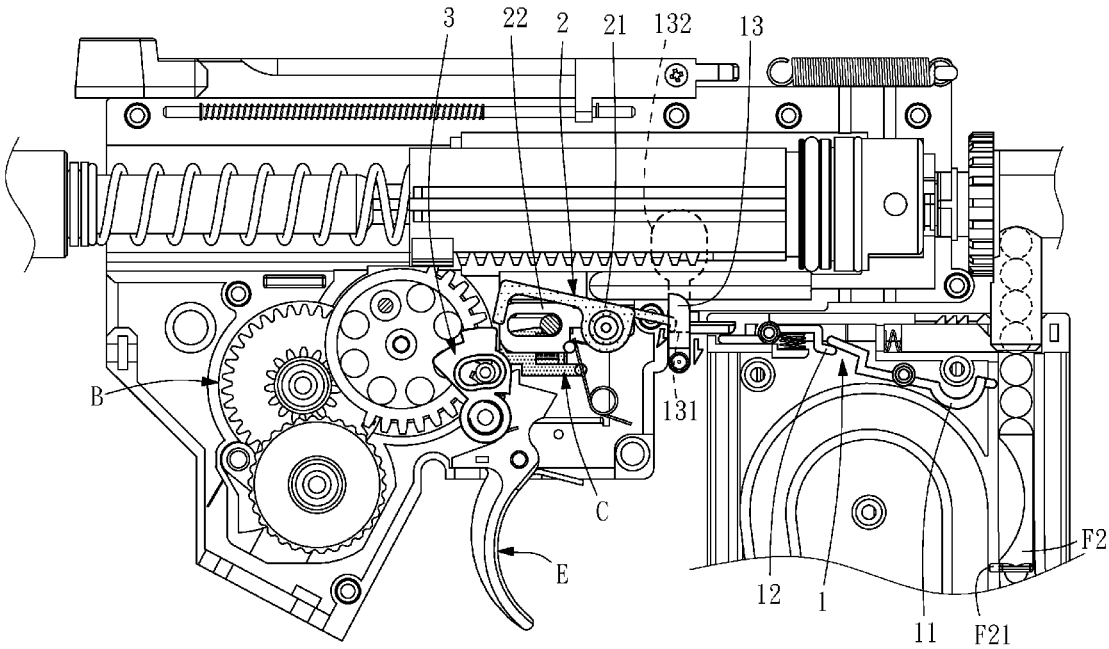
FIG. 9 is a schematic drawing showing the reset button pressed and the swivel rod returned to its former position.

Further, a reset button 132 is located on the third link 13 of the actuator 1 (see FIGS. 4 and 9). The reset button 132 extends out of the gun body of the electric toy gun. When presses the reset button 132 as the swivel rod 21 of the power break control set 2 is kept in horizontal, the swivel rod 21 is returned to its former downwardly forwardly sloping position. Actually, if the clip F is detached from the electric toy gun, the swivel rod 21 is returned to its former forwardly downwardly sloping position subject to the return action of the actuator 1.

As stated above, the matching arrangement of the power break control mechanism A, the push rod B12, the stop rod C1 and the side protrusion F21 enables the electric toy gun to automatically break off power supply when the clip of the electric toy gun is empty, avoiding power waste and component damage. Thus, the invention effectively eliminates the drawbacks of the prior art design.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electric toy gun comprising a power break control mechanism, a gearwheel set, a power break holder, a power contact holder, a trigger and a clip, said trigger having a protrusion adapted for moving said power break holder forwardly to contact with said power contact holder when said trigger is pressed, said power break holder being spring loaded for automatic return after having been moved forwards, said clip having a bullet outlet and a spring-loaded push rod pivotally connected to a part thereof near said bullet outlet, said power break control mechanism being adapted to break off power supply when said trigger is released after each firing action, wherein:

said gearwheel set has a push rod;

said spring-loaded push rod has a side protrusion;

said power break control mechanism comprises an actuator, a power break control set and a swinging block;

said spring-loaded push rod of said clip is turned upwards to force said side protrusion against said actuator and to further bias said power break control set to a position where a rear side of said power break control set is lowered to one lateral side of said swinging block when said clip is empty, therefore when said gearwheel set is rotated to force the push rod thereof against said swinging block upon triggering of said trigger at this time, said swinging block is rotated to move said power break control set in moving said power break holder away from the protrusion of said trigger for enabling said power break holder to be biased backwards by spring means loaded thereon and moved away from said power contact holder to break off power supply.

2. The electric toy gun as claimed in claim 1, wherein said gearwheel set comprises a first gearwheel carrying the push rod of said gearwheel set.

3. The electric toy gun as claimed in claim 1, wherein said swinging block is spring loaded for automatic return, having a pivot hole coupled to a first pivot inside the electric toy gun for enabling said swinging block to be turned about said first pivot and an arched hole coupled to a second pivot inside the electric toy gun to limit the turning angle of said swinging block about said first pivot.

4. The electric toy gun as claimed in claim 3, wherein said power break control set comprises a swivel rod and a power break control block, said swivel rod having a middle part thereof pivotally connected to a front part of said power break control block for enabling said swivel rod to be moved with said power break control block when said swinging block is forced to move said power break control set, said power break control block having an elongated slot and a beveled edge, said elongated slot of said power break control block being coupled to a fixed guide rod in the electric toy gun for enabling said power break control block to be moved horizontally when said swivel rod is biased; said power break holder has a stop rod; when said swinging block is forced to move said power break control set, said beveled edge of said power break control block is forced against the stop rod of said power break holder, causing said power break holder to be moved away from the protrusion of said trigger.

5. The electric toy gun as claimed in claim 4, wherein said beveled edge of said power break control block slopes downwardly forwards.

6. The electric toy gun as claimed in claim 5, wherein said power break control block moves horizontally when said power break control set is moved by said swinging block.

7. The electric toy gun as claimed in claim 6, wherein said swivel rod is forced to move said power break control block in horizontal when pushed by said swinging block.

8. The electric toy gun as claimed in claim 7, wherein said actuator comprises a first link, a second link and a third link, said second link being coupled between said first link and said third link, said third link having a bearing portion adapted for moving a front end of said swivel rod upwards when said side protrusion of said spring-loaded push rod is turned upwards to move said actuator; said actuator is spring loaded for automatic position return when said side protrusion of said spring-loaded push rod is moved away from said first link.

9. The electric toy gun as claimed in claim 8, wherein said swivel rod is kept in a forwardly downwardly sloping position when said side protrusion of said spring-loaded push rod is kept away from said actuator; said swivel rod is turned to horizontal to keep a rear end thereof at one lateral side relative to said swinging block when said side protrusion of said spring-loaded push rod touches said actuator.

10. The electric toy gun as claimed in claim 9, wherein said actuator further comprises a reset button located on said third link and extending out of the electric toy gun for pressing by a user to return said swivel rod from said horizontal position to said forwardly downwardly sloping position.

* * * * *